United States Patent [19]

Radlmann et al.

[11] 4,143,200

[45] Mar. 6, 1979

[54] SYNTHETIC FILAMENTS AND FIBRES WITH HIGH MOISTURE ABSORPTION AND WATER RETENTION CAPACITY

[75] Inventors: Eduard Radlmann; Ulrich Reinehr; Günther Nischk, all of Dormagen, Fed. Rep. of Germany

[73] Assignee: Bayer Aktiengesellschaft, Leverkusen, Fed. Rep. of Germany

[21] Appl. No.: 769,724

[22] Filed: Feb. 17, 1977

[30] Foreign Application Priority Data

Feb. 21, 1976 [DE] Fed. Rep. of Germany ..... 2607071

[51] Int. Cl.[2] ..... D02G 3/00

[52] U.S. Cl. ..... 428/373; 264/206; 428/374; 428/398

[58] Field of Search ..... 428/373, 374, 376, 397, 428/398; 264/206

[56] References Cited

U.S. PATENT DOCUMENTS

| | | | |
|---|---|---|---|
| 3,038,238 | 6/1962 | Wu | 428/374 |
| 3,957,936 | 5/1976 | Lauchenauer | 428/398 X |
| 3,984,515 | 10/1976 | Mommaerts | 428/398 X |
| 3,984,601 | 10/1976 | Blickenstaff | 428/376 X |

*Primary Examiner*—Lorraine T. Kendell
*Attorney, Agent, or Firm*—Plumley and Tyner

[57] ABSTRACT

The invention relates to a process for the production of filaments and fibres having a moisture absorption of at least 7% and a water retention capacity of at least 25% by dry-spinning an acrylonitrile copolymer, containing more than 50 mval of carboxyl groups from a solvent, which contains 5 to 50% by weight of a compound with properties defined herein, washing the compound added to the solvent out of the freshly spun filaments and fibres and partly or completely converting the carboxyl groups into the salt form. The invention further relates to dry-spun filaments and fibres having a core and sheath structure, comprising a fibre-forming acrylonitrile copolymer having more than 50 mval of carboxyl and carboxylate groups and having a moisture absorption capacity of at least 7% and a water retention capacity of at least 25%.

6 Claims, No Drawings

SYNTHETIC FILAMENTS AND FIBRES WITH HIGH MOISTURE ABSORPTION AND WATER RETENTION CAPACITY

This invention relates to synthetic filaments and fibres which have values for moisture absorption and water retention capacity far above the known values for cotton.

According to an earlier proposal, synthetic filaments having a moisture absorption capacity almost equal to that of cotton and a correspondingly high water retention capacity are provided by spinning preferably acrylonitrile polymers by a dry spinning process and adding to the spinning solvent a substance which has a higher boiling point than the spinning solvent, which is miscible with the spinning solvent and water and which is a non-solvent for the polymer, this substance being removed by washing in the course of the after-treatment.

It has now been found that the moisture absorption and water retention capacity can be further improved when acrylonitrile copolymers having carboxyl groups are spun by a dry-spinning process from a solvent containing a substance which has quite specific properties and which is washed out again in the course of the after-treatment.

Accordingly, it is an object of the present invention to provide acrylonitrile filaments and fibres having improved moisture absorption. It is a further object to provide acrylonitrile fibres and filaments with improved water retention capacity.

Still another object is to provide acrylonitrile fibres and filaments with improved moisture absorption and improved water retention capacity as well as a process for their production. These and other objects which will be evident from the following description and the examples are accomplished by a process for the production of acrylonitrile filaments and fibres having a moisture absorption of at least 7% (at 65% relative humidity and 21° C) and a water retention capacity of at least 25% which comprises a. dry-spinning an acrylonitrile copolymer containing more than 50 mval of carboxyl groups per kg of polymer from
b. a solvent to which 5 to 50% by weight, based on the total weight of solution, of a compound has been added, which compound has a boiling point higher than that of the spinning solvent and which is miscible with water and the spinning solvent and which is a non-solvent for the copolymer,
c. washing the compound added to the solvent out of the freshly spun fibres, and
d. converting the carboxyl groups partly or completely into the salt form.

These filaments and fibres constitute another aspect of this invention.

The acrylonitrile copolymers containing carboxyl groups are prepared by known processes of copolymerisation of acrylonitrile with carboxyl-containing comonomers such as acrylic acid, methacrylic acid, itaconic acid, undecylenic acid or compounds of the general formula:

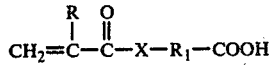

wherein

R denotes a hydrogen or methyl group,
X denotes —O— or —NH—, and
$R_1$ denotes an alkylene or phenylene group.

The copolymers may contain as comonomer components monomers with sulphonate groups or nitrogen in a quantity to enable an excellent dyability with basic or acid dyes, e.g. comonomers such as methallyl sulphonate or N,N-dialkylamino-ethyl acrylates.

The solvents used may be the usual solvents employed for dry spinning acrylonitrile polymers, e.g. dimethylformamide, dimethylacetamide, dimethylsulphoxide or N-methylpyrrolidone.

The substances or mixtures of substances added to the solvent should have a boiling point higher than that of the solvent by preferably about 50° C, they should be miscible with water and the solvent, preferably in any proportions, and they should be non-solvents for the polymer, i.e. the copolymer should at the most undergo only slight dissolution in the liquid. The good solubility in water is important to ensure complete removal of the substance during the aqueous after-treatment of the fibres. Furthermore, it is advantageous to select compounds which do not form an azeotropic mixture with the spinning solvent used so that they can be recovered as far as possible quantitatively.

Suitable compounds include, for example, monosubstituted or polysubstituted alkyl ethers and esters of polyhydric alcohols, such as diethylene glycol monomethyl or dimethyl ether, diethylene glycol monoethyl or diethyl ether, diethylene glycol, triethylene glycol, tripropylene glycol, triethylene glycol diacetate, tetraethylene glycol, tetraethylene glycol dimethyl ether, glycol ether acetate, e.g. butyl glycol acetate, high boiling alcohols, e.g. 2-ethylcyclohexanol, esters or ketones, trimethylolpropane, mannitol, sorbitol, glucose or, preferably, glycerol, or mixtures thereof.

The substances are added to the solution in quantities of from 5 to 50% by weight, preferably from 10 to 20%, based on the total weight. The quantity which can be added is limited by the fact that the polymer solution must still be capable of being spun. On the other hand, it is desirable to add as much of this substance as possible because the porosity of the spun fibres and hence also their water retention capacity, is then correspondingly higher. However, it is also necessary to ensure that during the dry spinning process in the spinning shaft, as little as possible of the added substance evaporates or is carried away with the evaporating solvent, so that the filament obtained has a core and sheath structure. The substance still left in the filament is completely removed from the fibres only during the subsequent stretching process in water or steam or the following washing and drying process. As a result of this sequence of after-treatments, the originally compact sheath of the filament becomes microporous. This procedure results in high values for water retention capacity, whereas if the sequence is reversed, for example, i.e. if washing is followed by stretching and drying, the compact sheath structure is preserved because the substance added is washed out before the stretching process so that the resulting cavities are closed by stretching. The result is a lower water-retention capacity. The optimum washing process is that in which the fibres are kept under only a slight tension at temperatures of up to 100° C and during a time of at least 10 seconds. The subsequent after-treatments may be carried out after the usual steps such as dressing crimping, drying and cutting, optimum results being obtained with mild drying conditions, employing temperatures of not more than 160° C and preferably 110° to 140° C, and short times in the drier of not more than 2 to 3 minutes.

The fibres and filaments produced by the process described above have a core and sheath structure in which, viewed in cross-section the area of the sheath amounts to about 30% of the total cross-sectional area. The core is always microporous. The average diameter of the pores is from 0.5 to 1 $\mu$. The sheath may also be microporous, depending on the after-treatment conditions employed.

The cross-sectional shape of the new fibres and filaments differs markedly from the known dumb-bell shape of dry-spun fibres. Irregular, trilobal, mushroom-shaped, circular or kidney bean shaped structures are found, depending on the spinning conditions and quantity of compound added.

Whereas both the nature and quantity of the substance added and the spinning and after-treatment conditions employed are of major importance in determining the water retention capacity of the filaments and fibres according to the invention, the moisture absorption capacity depends decisively on the chemical composition of the copolymer. According to the invention, only acrylonitrile copolymers having carboxyl groups in side chains at a concentration of more than 50 mval per kg have, in addition to high water retention capacity, values for moisture absorption of about 7 to about 15% if the free carboxyl groups are partly or completely converted into corresponding carboxylates. The metal cations of lithium, potassium, sodium, calcium and aluminium or also ammonium cations prove to be particularly effective in this respect. If divalent or higher valent cations are used, the filaments are in addition cross-linked and have a high softening temperature and increased crimping capacity. Conversion of the free carboxyl groups into the salts is suitably carried out at some stage during the after-treatment process or at the end of the process, and consists of treating the fibres with a preferably 1 to 15% aqueous solution of at least one of the suitable metal or ammonium salts at a pH of more than 6. The treatment time of the fibres is adjusted according to the desired degree of neutralisation and lies within the range of from 1 to 30 minutes. The temperature of the bath may be in the region of from 10° to 100° C. This step of the process and a subsequent washing process preferably follow the first washing process. Preferably, at least 10% of the carboxyl groups are neutralised by the neutralisation process.

In addition to good filament properties such as high tensile strength, elongation on tearing and dye absorption capacity, the filaments according to the invention show a hitherto unknown combination of high water retention capacity with high moisture absorption.

It is possible, by the method of the invention, to obtain types of filaments having combinations of properties far superior to those of cotton. This is of great practical importance because these two factors are important physical properties for textiles used in clothing. One advantage of the filaments according to the invention compared with cotton filaments is that cotton which has absorbed a large quantity of water has a wet feel, whereas the new filaments, by virtue of their porous core and sheath structure and their hydrophilic character, allow the water to diffuse into the core so that textiles worn next to the skin feel comparatively dry even under conditions of heavy perspiration and are comfortable to wear.

Determination of the moisture absorption (FA)

The moisture absorption based on the dry weight of the filaments is determined gravimetrically. The samples are exposed to an atmosphere of 21° C and 65% relative humidity for 24 hours. To determine the dry weight, the samples are then dried to constant weight at 105° C. The moisture absorption (FA) in percent by weight is:

$$FA = (m_f - m_{tr}/m_{tr}) \times 100$$

where $m_f$ = weight of moisture of the filaments at 21° C and 65% relative humidity, and $m_{tr}$ = dry weight of the filament.

Determination of the water retention capacity (WR)

The water retention capacity is determined in accordance with DIN specification 53 814 (see Melliand Textilberichte 4 1973, page 350).

The filament samples are dipped for 2 hours in water containing 0.1% of wetting agent. They are then centrifuged for 10 minutes at an acceleration of 10,000 m/sec$^2$ and the quantity of water retained in and between the filaments is determined gravimetrically. To determine the dry weight, the filaments are dried at 105° C to a constant moisture content. The water retention capacity (WR) in percent by weight is:

$$WR = (m_f - m_{tr}/m_{tr}) = 100$$

where $m_f$ = weight of moist filament goods, and $m_{tr}$ = weight of dry filament goods.

In the following Examples which are to further illustrate the invention without limiting it, parts and percentages quoted are based on weight.

EXAMPLE 1

2.85 kg of an acrylonitrile/acrylic acid copolymer composed of 90% of acrylonitrile and 10% of acrylic acid (139 mval of carboxyl groups per kg) are dissolved in a mixture of 10.00 kg of dimethylformamide and 2.15 kg of glycerol at 80° C for 1 hour, filtered and dry spun by known methods at a shaft temperature of 160° C. The viscosity of the solution is 82 falling seconds (for determination of viscosity by falling ball method see K. Jost, Rheologica Acta Volume 1, No. 2- 3 (1958), page 303). The spun goods are collected on spools and doubled to form a cable still containing 13.9% of glycerol. The cable is then stretched in a ratio of 1:3.6 in boiling water, washed in boiling water under a slight tension for 3 minutes, thereupon passed under a light tension through an aqueous bath containing about 10% by weight of sodium carbonate at 25° C for 5 minutes and finally again washed in boiling water for 3 minutes. An antistatic dressing is then applied and the cable is then dried in a sieve drum drier at a maximum temperature of 130° C and under conditions permitting 20% shrinkage, and it is then cut up into staple fibres 60 mm in length.

The individual filaments having a titre of 3.3 dtex have a moisture absorption capacity of 9.2% and a water retention capacity of 92%, an ultimate tensile strength of 1.8 p/dtex and an elongation on tearing of 25.9%. Under an optical microscope, the fibres show a clear core and sheath structure of irregular cross-section. The proportion of residual solvent in the filaments is less than 0.2% and the proportion of glycerol still left in the filaments is less than 0.6%. The filaments can be dyed to a deep colour with blue dye having the constitution:

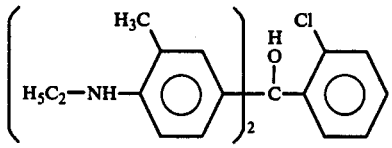

EXAMPLE 2

6.0 kg of an acrylonitrile/itaconic acid copolymer of 90% of acrylonitrile and 10% itaconic acid (154 mval carboxyl groups per kg) are dissolved in a mixture of 16.5 kg of dimethylformamide and 3.5 kg of diethylene glycol (viscosity: 69 falling seconds) as in Example 1, spun and after-treated, the only difference being that after the first 3 minutes' washing process, the cable is passed under a light tension through a bath containing about 5% by weight of lithium hydroxide for 5 minutes at 25° C. The filaments having an ultimate titre of 3.3 dtex showed a pronounced core and sheath structure with trilobal cross-section. The moisture absorption was 11.2% and the water retention capacity was 108%.

EXAMPLE 3

4.2 kg of an acrylonitrile copolymer of 82% of acrylonitrile, 3% of methyl acrylate and 15% of 10-undecenic carboxylic acid (82 mval of carboxyl group per kg) in a mixture of 8.6 kg of dimethylformamide and 2.17 kg of glycerol are processed into fibres in the same way as described in Example 1.

The individual filaments having a titre of 3.3 dtex have a moisture absorption capacity of 8.6%, a water retention capacity of 56.5% and a core and sheath structure of irregular cross-section.

EXAMPLE 4

5.1 kg of an acrylonitrile copolymer of 85% acrylonitrile and 15% of N-methacryloyl-3-aminosalicyclic acid of the formula:

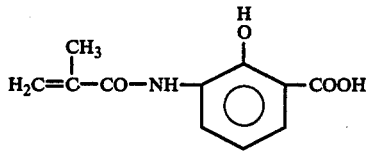

(68 mval of carboxyl groups per kg) are dissolved in a mixture of 19.9 kg of dimethylformamide and 4.8 kg of glycerol and, as described in Example 1, processed into filaments having a titre of 3.3 dtex and a core and sheath structure of irregular cross-section. The moisture absorption was 8.1% and the water retention capacity was 63.8%.

What is claimed is:

1. A dry-spun filament or fiber having a sheath-core structure with a microporous core, both sheath and core of said filament or fiber comprising a fiber-forming acrylonitrile copolymer having more than 50 mval of carboxyl and carboxyl salt groups per kilogram of copolymer at least 10% of which are carboxyl salt groups, and having a moisture absorption capacity of at least 7% (at 65% relative humidity and 21° C.) and a water retention capacity of at least 25%.

2. The filament or fiber of claim 1 having more than 50 mval of carboxyl and carboxyl salt groups in which substantially all of said groups are in the carboxyl salt form.

3. The filament or fiber of claim 1 in which said carboxyl salt is a salt of lithium, potassium, sodium, calcium, aluminium or ammonium.

4. The filament or fiber of claim 1 in which said carboxyl salt contains a cation which is divalent or of a higher valence and the acrylonitrile filament or fiber is cross-linked.

5. The filament or fiber of claim 1 in which the cross-sectional area of the sheath is about 30% of the total cross-sectional area, and the average diameter of the pores in the core is from 0.5 to 1$\mu$.

6. The filament or fiber of claim 5 wherein the sheath is also microporous.

* * * * *